US007059614B2

(12) United States Patent
Cole, III

(10) Patent No.: US 7,059,614 B2
(45) Date of Patent: Jun. 13, 2006

(54) FREELY ROTATABLE BINDING FOR SNOWBOARDING AND OTHER SINGLE-BOARD SPORTS

(76) Inventor: Charles D. Cole, III, 405 W. Palm Ave., Redlands, CA (US) 92373

( * ) Notice: Subject to any disclaimer, the term of this patent is extended or adjusted under 35 U.S.C. 154(b) by 0 days.

(21) Appl. No.: 10/795,636

(22) Filed: Mar. 8, 2004

(65) Prior Publication Data

US 2004/0169351 A1 Sep. 2, 2004

Related U.S. Application Data

(63) Continuation of application No. 10/325,520, filed on Dec. 19, 2002, now abandoned, which is a continuation of application No. 09/622,632, filed as application No. PCT/US99/03351 on Feb. 17, 1999, now abandoned.

(60) Provisional application No. 60/074,948, filed on Feb. 17, 1998, provisional application No. 60/090,876, filed on Jun. 26, 1998.

(51) Int. Cl.
*A63C 9/02* (2006.01)

(52) U.S. Cl. ..... 280/14.24; 280/14.22; 280/623; 280/634

(58) Field of Classification Search ..... 280/14.22, 280/14.23, 14.24, 623, 636, 618; 441/70
See application file for complete search history.

(56) References Cited

U.S. PATENT DOCUMENTS

| | | | | |
|---|---|---|---|---|
| 2,955,300 | A | 10/1960 | Hedlund et al. | 280/607 |
| 4,386,915 | A * | 6/1983 | Gilliam | 434/253 |
| 4,964,649 | A | 10/1990 | Chamberlin | 280/618 |
| 5,028,068 | A | 7/1991 | Donovan | 280/618 |
| 5,054,807 | A | 10/1991 | Fauvet | 280/607 |
| 5,188,386 | A | 2/1993 | Schweizer | 280/607 |
| 5,277,635 | A * | 1/1994 | Gillis | 441/74 |
| 5,520,405 | A | 5/1996 | Bourke | 280/613 |
| 5,586,779 | A * | 12/1996 | Dawes et al. | 280/14.24 |
| 5,667,237 | A | 9/1997 | Lauer | 280/607 |
| 5,791,678 | A | 8/1998 | Perlman | 280/618 |
| 5,803,481 | A | 9/1998 | Eaton et al. | 280/633 |
| 5,813,688 | A | 9/1998 | Dacklin | 280/607 |
| 5,820,139 | A | 10/1998 | Grindl | 280/14.2 |
| 5,826,910 | A | 10/1998 | Ricks et al. | 280/618 |
| 5,868,416 | A | 2/1999 | Fardie | 280/607 |
| 5,890,729 | A | 4/1999 | Bayer et al. | 280/618 |
| 5,897,128 | A * | 4/1999 | McKenzie et al. | 280/607 |
| 5,913,530 | A | 6/1999 | Berger et al. | 280/607 |
| 5,915,718 | A | 6/1999 | Dodge | 280/607 |
| 5,971,419 | A | 10/1999 | Knapschafer | 280/607 |
| 6,022,040 | A * | 2/2000 | Buzbee | 280/613 |
| 6,062,584 | A | 5/2000 | Sabol | 280/607 |
| 6,155,591 | A | 12/2000 | Huffman et al. | 280/618 |
| 6,203,051 | B1 * | 3/2001 | Sabol | 280/607 |
| 6,290,423 | B1 | 9/2001 | Jungkind | 280/607 |
| 6,318,749 | B1 * | 11/2001 | Eglitis et al. | 280/607 |
| 6,450,511 | B1 * | 9/2002 | LaVoy | 280/14.22 |
| 6,491,310 | B1 * | 12/2002 | Work | 280/14.24 |
| 6,575,489 | B1 * | 6/2003 | White | 280/613 |
| 2005/0194753 | A1 * | 9/2005 | Craven et al. | 280/14.24 |

* cited by examiner

*Primary Examiner*—Jeffrey J. Restifo
(74) *Attorney, Agent, or Firm*—Khorsandi Patent Law Group, A Law Corporation; Marilyn R. Khorsandi

(57) ABSTRACT

A freely rotatable binding base assembly for use on a board used in single-board sports such as snowboarding and slalom water skiing. A binding assembly mounted on and movably secured to the board, and is adapted to receive a conventional boot as worn by a rider. Additional features include a locking means for selectably blocking rotation, and a clutch for braking rotation by applying side loading to the board.

20 Claims, 7 Drawing Sheets

FREELY ROTATABLE BINDING FOR SNOWBOARDING AND OTHER SINGLE-BOARD SPORTS

CROSS-REFERENCE TO RELATED APPLICATIONS

This application is a continuation application of U.S. patent application Ser. No. 10/325,520, filed Dec. 19, 2002, entitled "Freely Rotatable Binding For Snowboarding and Other Single-Board Sports", which is a continuation application of U.S. patent application Ser. No. 09/622,632, filed Aug. 17, 2000, entitled "Freely Rotatable Binding For Snowboarding and Other Single-Board Sports", which is a U.S. National Stage Application which claims benefit of International Application No. PCT/US99/03351, International Filing Date Feb. 17, 1999, entitled "Freely Rotatable Binding For Snowboarding and Other Single-Board Sports", which claims benefit of U.S. Provisional Applications 60/074948, filed Feb. 17, 1998, entitled "Freely Rotatable Binding For Snowboarding and Other Single-Board-Sports", and 60/090876, filed Jun. 26, 1998, entitled "Freely Rotatable Binding For Snowboarding and Other Single-Board Sports"; this application incorporates by reference the disclosures of all of the foregoing applications as if fully stated here for all purposes.

FIELD OF THE INVENTION

The present invention relates generally to a rotatable binding for a snowboard, wakeboard, or slalom water ski. In particular, the invention provides a freely rotatable binding allowing change of stance on the board without binding readjustment.

BACKGROUND OF THE INVENTION

Skateboarding has long been a popular form of recreation. This type of sport has been adapted to snow, in the form of snowboarding.

Snowboard design has developed predominantly from the ski industry and incorporates bindings, similar to those on skis, that clamp the feet into a stationary position on the ski. However, with snowboards, both feet are bound to a single "ski" or board in typically a diagonal orientation with respect to the length of the board. With these fixed stationary bindings, the rotational torque required for initiating turns is obtained by applying pressure to the inner or outer edge of the board.

Since the bindings are clamped into a static position, changing the position of the feet can only be done after releasing the bindings and then relocking them in the new position. This lack of movement of existing snowboard bindings results in limitations on their use. For example, walking to a ski lift with one foot removed from the snowboard is very difficult, since the other foot is bound in a diagonal position across the snowboard. This position results in an unnatural and awkward angle of the knee and ankle, and is a potential source of knee and ankle damage. Additionally, if a person falls while riding the snowboard, the fixed bindings do not allow knees and ankles to remain aligned, which may also result in an increased likelihood of physical injury. The static nature of the bindings also limits the maneuverability of the snowboard, when compared to the freedom experienced with skateboarding. An example of the limitation on maneuverability is the inability to ride the snowboard backwards while facing forward.

Alternate embodiments of existing snowboard bindings allow for adjustment of the angle of the binding with respect to the snowboard. These adjustments, however, require stopping to loosen the binding (typically locked with threaded fasteners which may require a tool for adjustment) for repositioning and tightening the binding after positioning is accomplished. No bearings are provided in the binding to allow free rotating movement, and some styles of adjustable bindings incorporate interfitting ribs which further impede free rotation even when the binding is unlocked. Major repositioning of one or both feet is not possible while the board is moving.

It is therefore desirable to provide a snowboard that has a binding that is dynamically and freely rotatable, to increase maneuverability and ease of use, and also to reduce risk of knee and ankle injury. These same principles are applicable to boards used in water sports such as wakeboarding and slalom water skiing.

SUMMARY OF THE INVENTION

The present invention relates to an improved sports board setup which allows for dynamic, free rotation of the bindings relative to the board. This design offers numerous advantages over currently available bindings for snowboards, for example, such as increased maneuverability of the snowboard, ease of use, and a significantly increased sensation of "floating" while riding. An additional, important advantage is the reduced probability of injury to knees and ankles resulting from use of the snowboard.

BRIEF DESCRIPTION OF THE DRAWINGS

Features, aspects, and advantages of the present invention will be more fully understood when reference is made to the following detailed description, appended claims, and accompanying drawings, where:

DETAILED DESCRIPTION OF THE INVENTION

Figure 1:
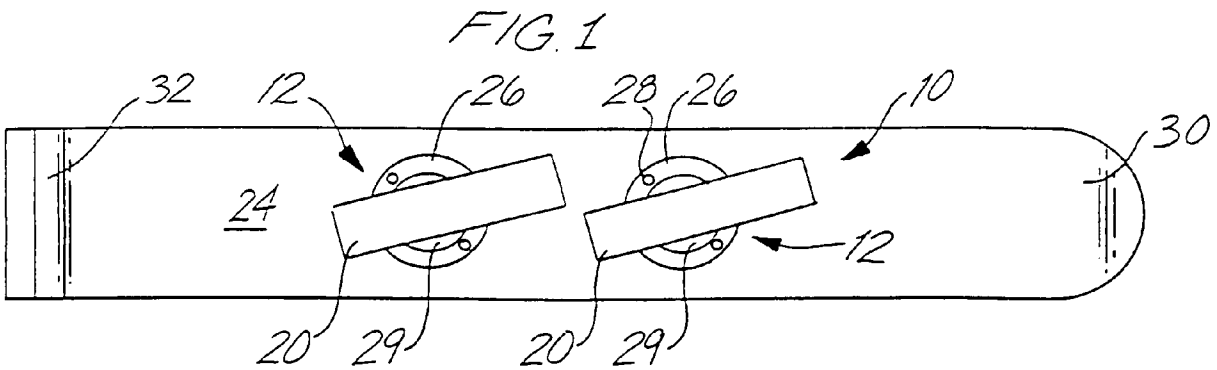
FIG. 1 is a schematic top view of a snowboard with heel and instep portions of a binding omitted for clarity.
Figure 2:
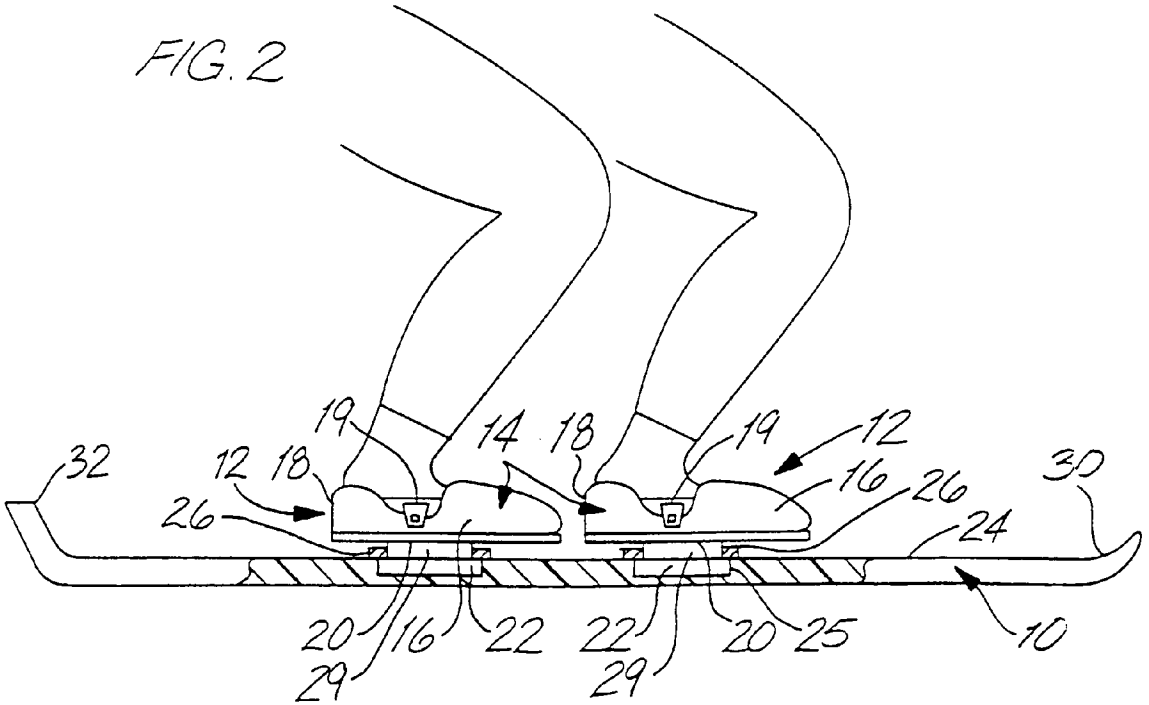
FIG. 2 is a schematic side view of a snowboard.

FIGS. 1 and 2 show a snowboard 10 with a pair of rotatable binding assemblies 12 spaced apart along a central longitudinal axis of the snowboard. Each rotatable binding assembly 12 incorporates a binding 14 having an instep element 16 and a heel element 18. When a booted foot is inserted into binding 14, the instep element is engaged by clamping it down onto the top of the boot, holding the boot firmly in place. The instep element prevents any forward or lateral motion of the foot relative to the binding. The heel element engages the heel of the boot and prevents any backward motion of the foot relative to the binding. A clamp 19, for securing the instep and heel elements to the boot may be of a buckle type, VELCRO, lacing, or other suitable type of clamp that will hold the instep and heel of the boot locked in place on the binding. Step-in or strap-in bindings are equally useful.

The heel and instep elements of binding 14 are attached to a rotatable plate 20. The bindings may be screwed to the rotatable plate, or the bindings and the rotatable plate may be designed to be a single, integral unit. The rotatable plate is mounted on a bearing 22. The bearing may be a friction ("plain") ball or roller bearing, or other suitable type of bearing which enables free rotation in the presence of both side loads and axial or thrust loads. Preferably, the bearing has a low profile, enabling the boots to be close to the upper surface of the board. The bearing is mounted on an upper surface 24 of the snowboard. In one embodiment, the bearing may be mounted in a cavity 25 (FIG. 2) in the upper surface of the snowboard. An outer race of the bearing is held in place by a mounting ring 26 and screws 28. The rotatable plate is attached to an inner race of the bearing by a cylindrical shaft or kingpin 29 secured to the plate and inner race. The bearing allows dynamic, free rotation of the binding relative to the snowboard.

The dynamic, free rotation of the binding offers advantages over other board bindings, and allows easier use of the snowboard and boards used in water sports. One example of the easier use is apparent when walking. One foot may be released from a binding, and the bound foot may be aligned with the longitudinal axis of the snowboard, rather than diagonally across the snowboard. This allows walking without having the foot, and hence the knee, oriented at an abnormal angle that could result in damage to either the knee or the ankle, or both.

In normal operation of the snowboard, the feet would be positioned diagonally across the snowboard, with the toes pointing toward a front end 30 of the snowboard. For certain trick maneuvers, the feet and bindings can quickly be oriented to positions perpendicular or nearly perpendicular to the longitudinal axis of the board. The operation of the rotatable binding utilizes the dynamic, free rotation of the feet bound to the snowboard.

In operation, rotational torque for turning the snowboard may be obtained by applying pressure to the inner or outer edge of the snowboard, as is used with skis and other snowboards. However, the rotatable bindings also allow rotational torque to be obtained by a push/pull motion of the feet. To obtain this turning motion, one foot is pushed forward as the other is pulled back, resulting in rotation of the binding relative to the snowboard. This action results in a rapid change in direction of the snowboard, rather than the more gradual change in direction that is obtained by applying pressure to the edge of the snowboard. As a result of this rotational motion of the bindings, the snowboard is highly maneuverable. This maneuverability, plus the ability to rapidly change the orientation of the feet relative to the snowboard, makes the rotatable-binding snowboard highly suited to tricks, freestyle, and racing maneuvers.

Also, since the bindings are rotatable, it is possible to incorporate riding the snowboard backwards, from a normal to a "goofy-footed" position, into tricks and freestyle. In order for the snowboard to be ridden backwards, the snowboard is rotated through 180°. The feet are rotated from a diagonal position with the toes directed toward the front of the snowboard, to a diagonal position with the toes pointing toward a back end 32 of the snowboard.

Falls are an inevitable part of most snow sports, and the rotatable bindings may be used to orient and align the feet and knees during a fall. This ability to spread impact forces results in reduced stress on knee and ankle joints, and significantly reduces the potential of injury to knees or ankles.

In an alternative version of the invention, stops can be provided to limit rotational motion of the bindings to about 120° (from slightly more than straight ahead to slightly more than an athwart position). In another embodiment, a clamp can be provided, enabling one of the bindings to remain in a fixed position, while the other binding (typically the rear binding, though the front binding may be selected for ease in exiting a chair lift) is freely rotatable.

Though primarily developed for use with snowboards, the binding of this invention also believed useful with other types of rideable boards such as used in the sports of wakeboarding and slalom waterskiing. The term "board" as used herein is accordingly defined as an elongated board to which both of the rider's feet are secured by bindings (in contrast to conventional skis in which a pair of boards are used, one for each foot).

Figure 3:
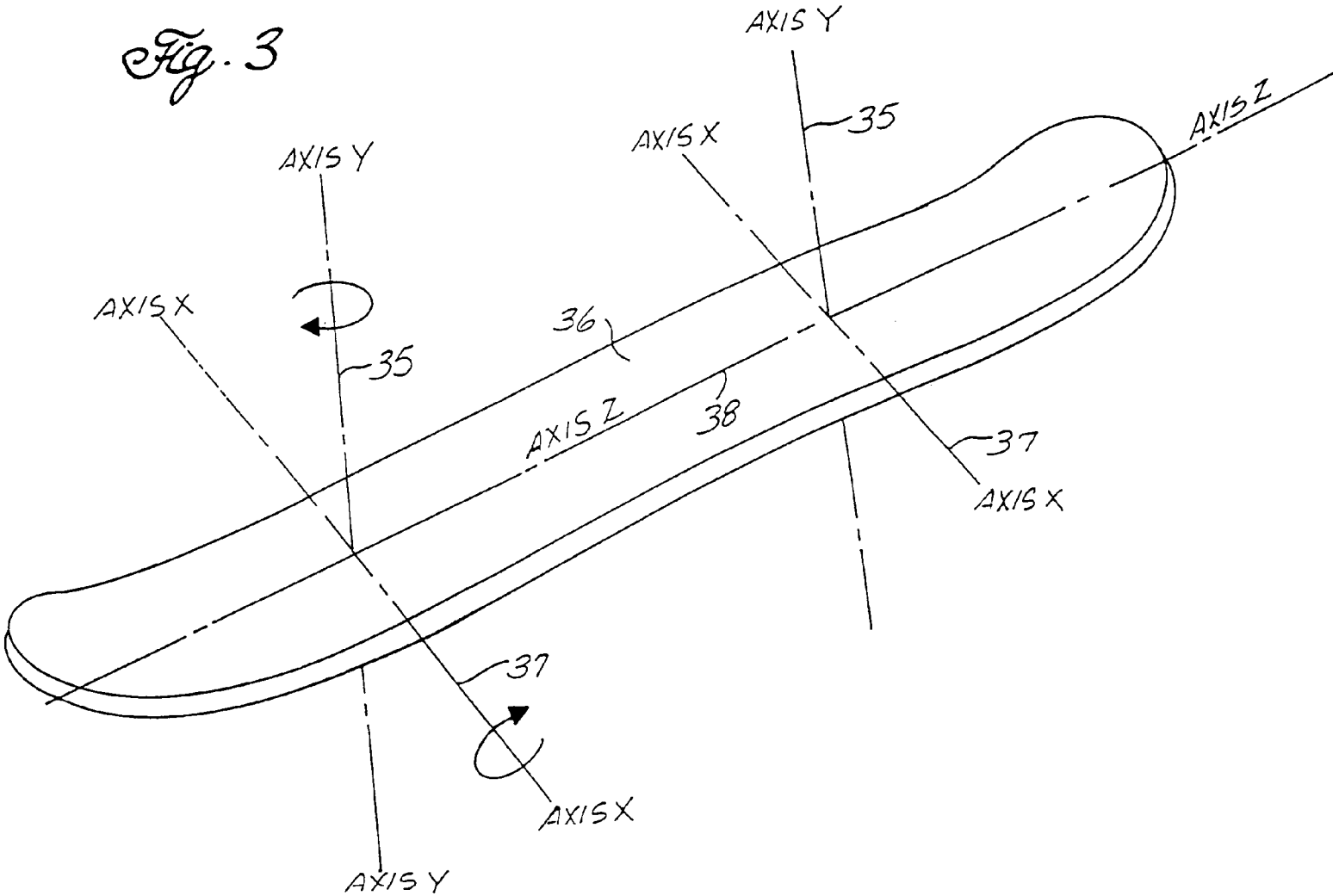
FIG. 3 is a perspective view showing X, Y and Z axes of a sport board.

Referring to FIG. 3, the embodiments thus far described relate to binding rotation around a Y axis 35 which is generally perpendicular to the upper surface of a board 36, and coincides the rotational axis of the binding. The board also has an X axis 37 which extends perpendicularly to the Y axis and perpendicularly to a Z axis 38 which corresponds to the longitudinal axis of the board. Limited rotation about the X axis can be incorporated in a binding either alone, or in combination with Y-axis rotation, and movement of one foot along the Z axis is also possible.

Figure 4:
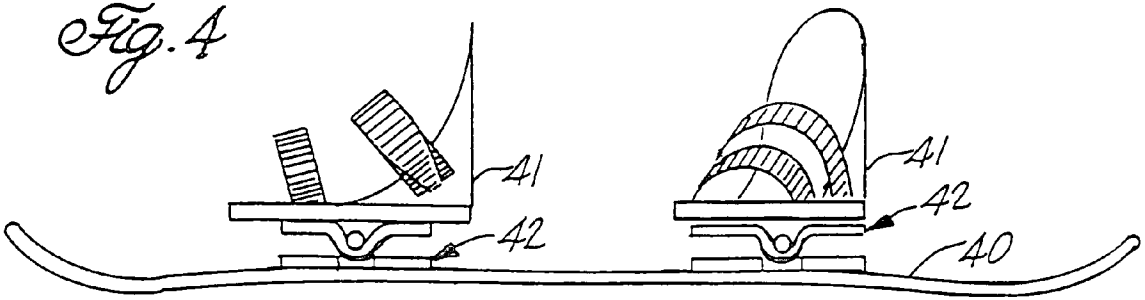
FIG. 4 is a side view of a board with bindings rotatable about an X axis.
Figure 5:
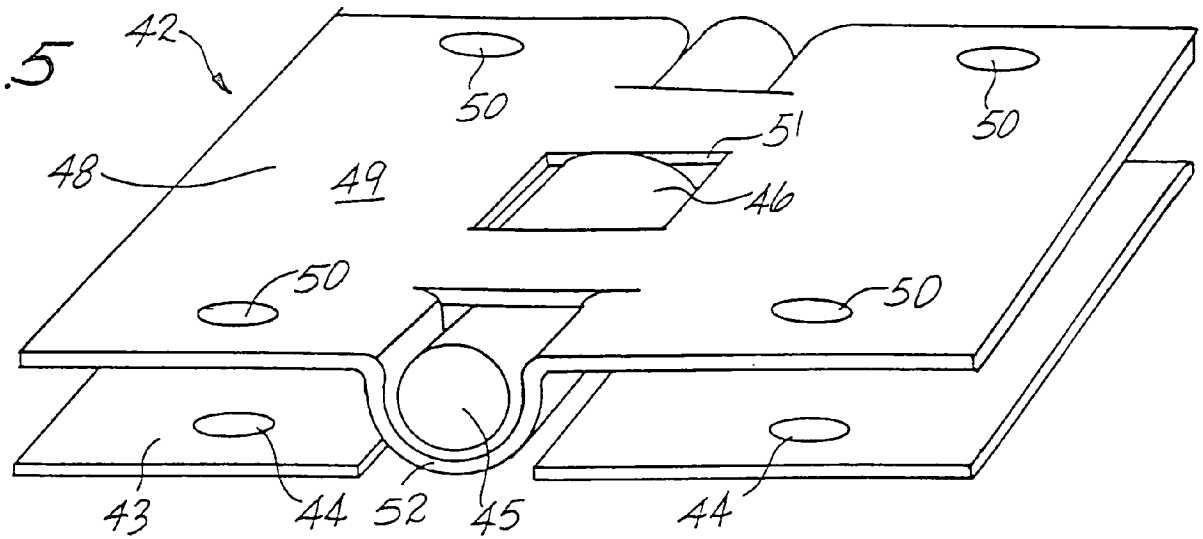
FIG. 5 is an enlarged view of hinge assembly enabling X-axis rotation.

FIG. 4 shows a board 40 with fore and aft bindings 41 mounted on hinge assemblies 42 shown in greater detail in FIG. 5. Each assembly 42 has a lower plate 43 rigidly secured to the board by fasteners (not shown) extending through holes 44. A pivot pin 45 extends through a socket-like raised central portion 46 of the lower plate, and a longitudinal axis of the pin corresponds to the X axis as described above.

Hinge assembly 42 has an upper plate 48 with a generally flat upper surface 49 to which a respective binding 41 is secured by fasteners (not shown) extending through holes 50. A central opening 51 provides clearance for portion 46 of the lower plate. The upper plate further defines partial-cylinder seats 52 on opposite sides of opening 51 to receive the opposite ends of pivot pin 45. Axial movement of pin 45 is prevented by securing the pin to either portion 46 or seats 52.

The hinge assembly enables each binding to be rocked about the X-axis to add a different degree of freedom for the rider's feet with respect to the board. X-axis and Y-axis rotation can be combined by mounting the Y-axis binding shown in FIGS. 1 and 2 to the top (but preferably not beneath in order to maintain edge or Z-axis control of hinge assembly 42 and board. Alternatively, one binding can be of this Y-axis above X-axis arrangement for edge control, and the other binding in the opposite configuration (X-axis above Y-axis) to provide the effect of a universal ball joint.

Another possible configuration is to mount one of the two bindings for limited movement along the Z-axis fore and aft on the board. This sliding movement can be parallel to the upper surface of the board, or can be along a rearwardly and upwardly sloping ramp on the board. The binding with such Z-axis movement can also incorporate Z-axis or Y-axis rotation, or both. Typically, a wider range of trick maneuvers become possible when additional degrees of freedom are provided in bindings.

Even if free binding movement is restricted to rotation about only the Y axis, there are made available the important advantages of faster turns, safe landings from difficult jumps, fewer falls with reduced impact forces, a broader range of trick maneuvers, and reduced ankle and knee stress when riding and exiting a lift during snow sports. Binding rotation enables optimal positioning of the feet during different riding conditions, as opposed to the single compromise positions of fixed bindings.

Figures 6, 10:
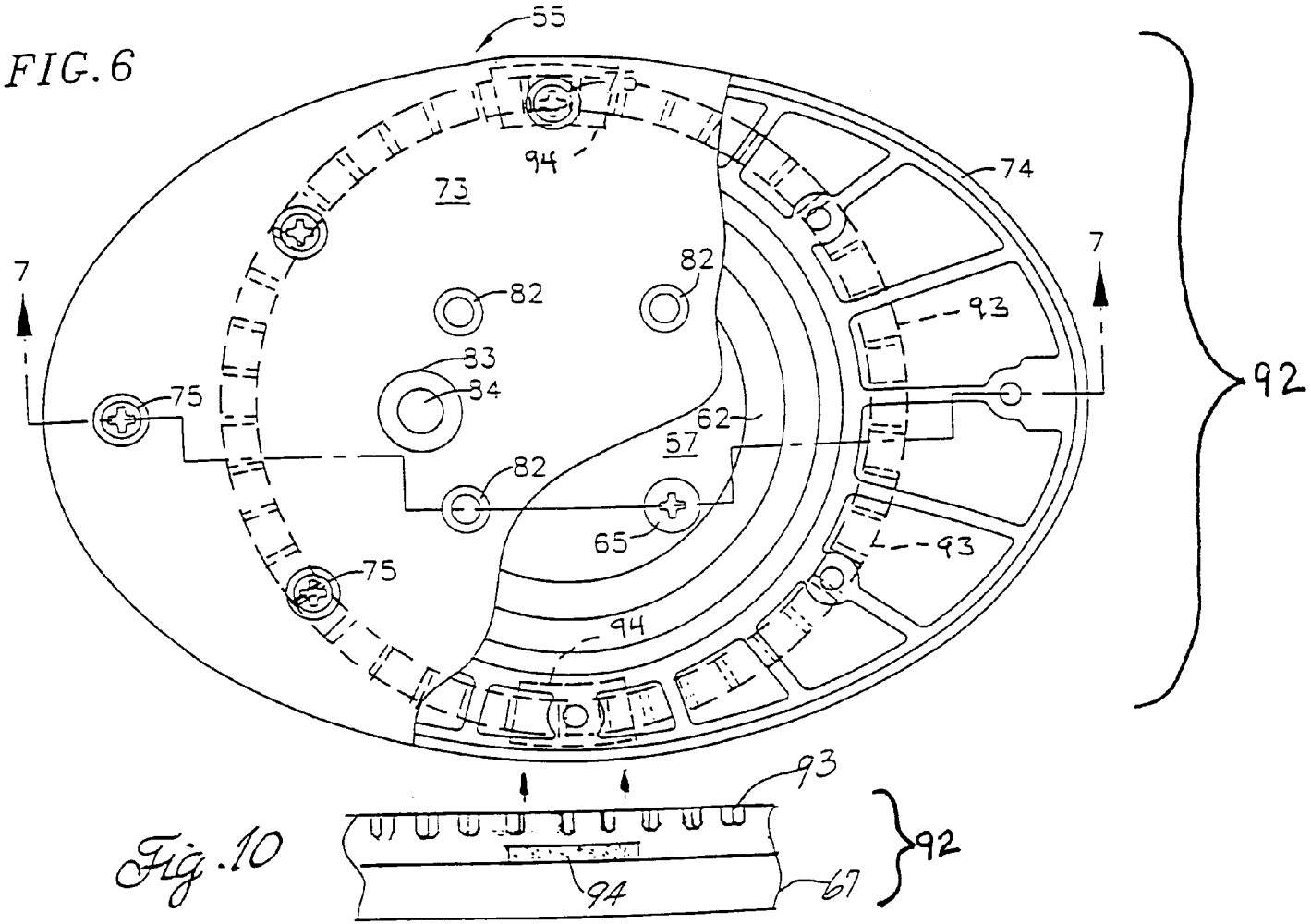
FIG. 6 is a top plan view, partly broken away, of another embodiment of a rotatable binding assembly according to the invention.
FIG. 10 is an enlarged side view of an exemplary fixed clutch portion that is depicted in FIG. 6 as an element below the surface of the exemplary clutch assembly depicted in FIG. 6.
Figure 7:
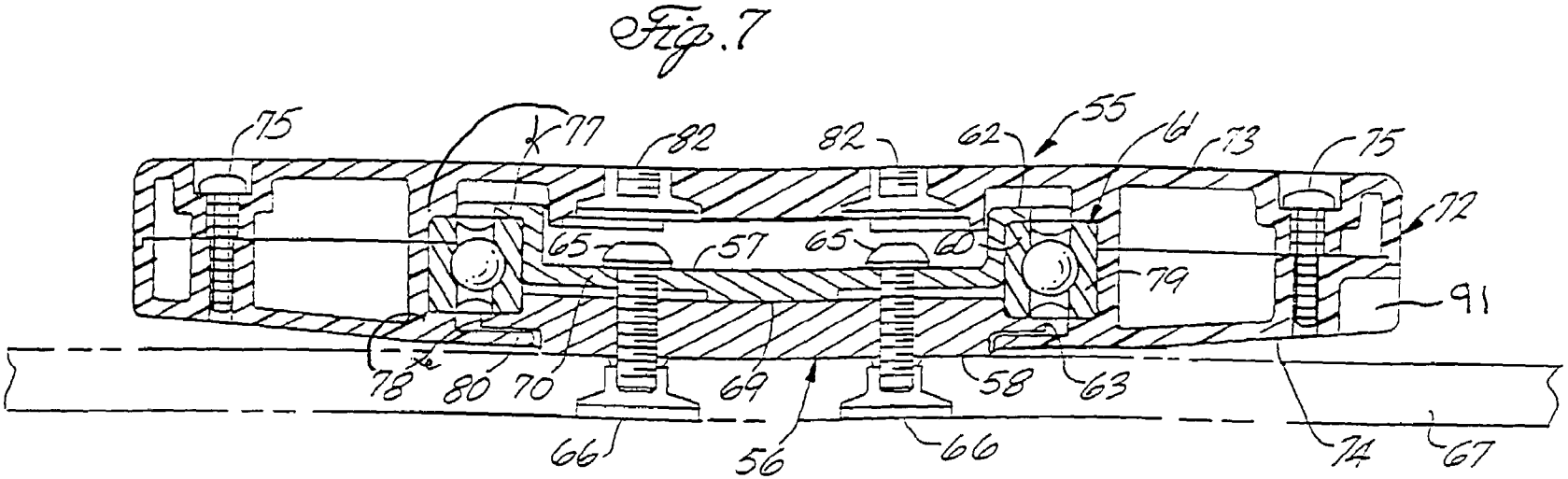
FIG. 7 is a sectional elevation on line 7—7 of FIG. 6.

Another and presently preferred rotatable binding base assembly 55 is shown in FIGS. 6 and 7. The assembly has a centrally positioned bearing clamp 56 with circular upper and lower plates 57 and 58. An inner race 60 of a ball-bearing assembly 61 is clamped between radially extending flanges 62 and 63 on plates 57 and 58 which are secured together by four screws 65 arranged in a square pattern and threaded into "T" nuts 66 recessed into the underside of a sports board 67.

Only a downwardly extending central circular portion 69 of upper plate 57 bears directly on lower plate 58. Radially outer portions 70 of the upper plate are spaced slightly from the lower plate so those portions can flex slightly when screws 65 are tightened to clamp the bearing inner race securely. Plates 57 and 58 are preferably made of a light-weight metal such as aluminum.

A generally elliptical binding-support assembly 72 has upper and lower plates 73 and 74 which are tightly secured together by screws 75. Inner vertical circular ribs 77 and 78 of the upper and lower plates are recessed to receive and be clamped against an outer race 79 of bearing assembly 61. A radially inwardly extending circular flange 80 of the lower plate is spaced slightly from lower plate 58 of the bearing clamp so assembly 72 can rotate freely around base assembly 55.

Four "T" nuts 82 arranged in a square pattern are recessed into the undersurface of upper plate 73 to receive screws for securing a binding (not shown) as previously described to binding-support assembly 72. Optionally, a circular opening 83 may be formed through upper plate 73 at the same radius from the center of the upper plate as the radial spacing of "T" nuts 82 from the center. This opening is normally closed by a circular resilient plug 84 which can be removed to enable removal of screws 65 (during installation or removal of assembly 55 from the board) without disassembly of binding support assembly 72.

Figure 8:
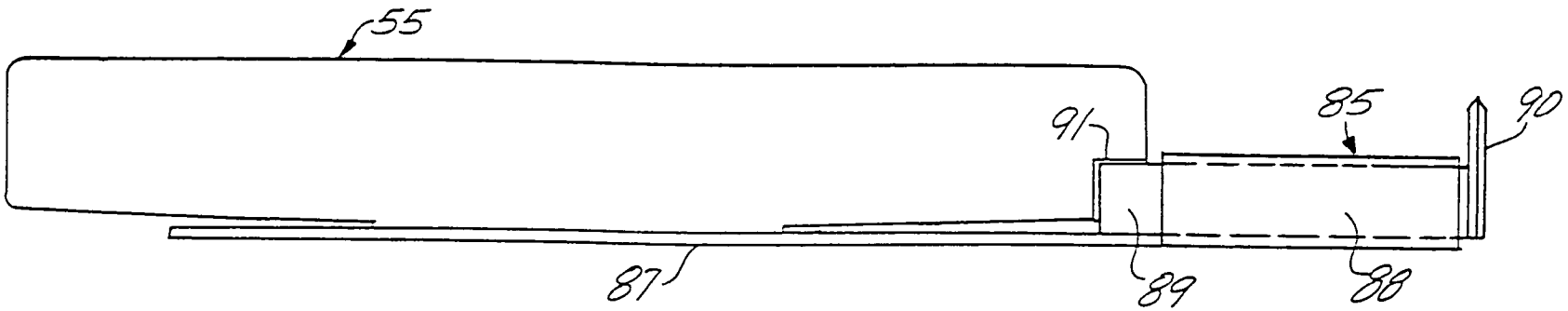
FIG. 8 is a side view of the binding assembly of FIGS. 6 and 7, with an added lock assembly.
Figure 9:
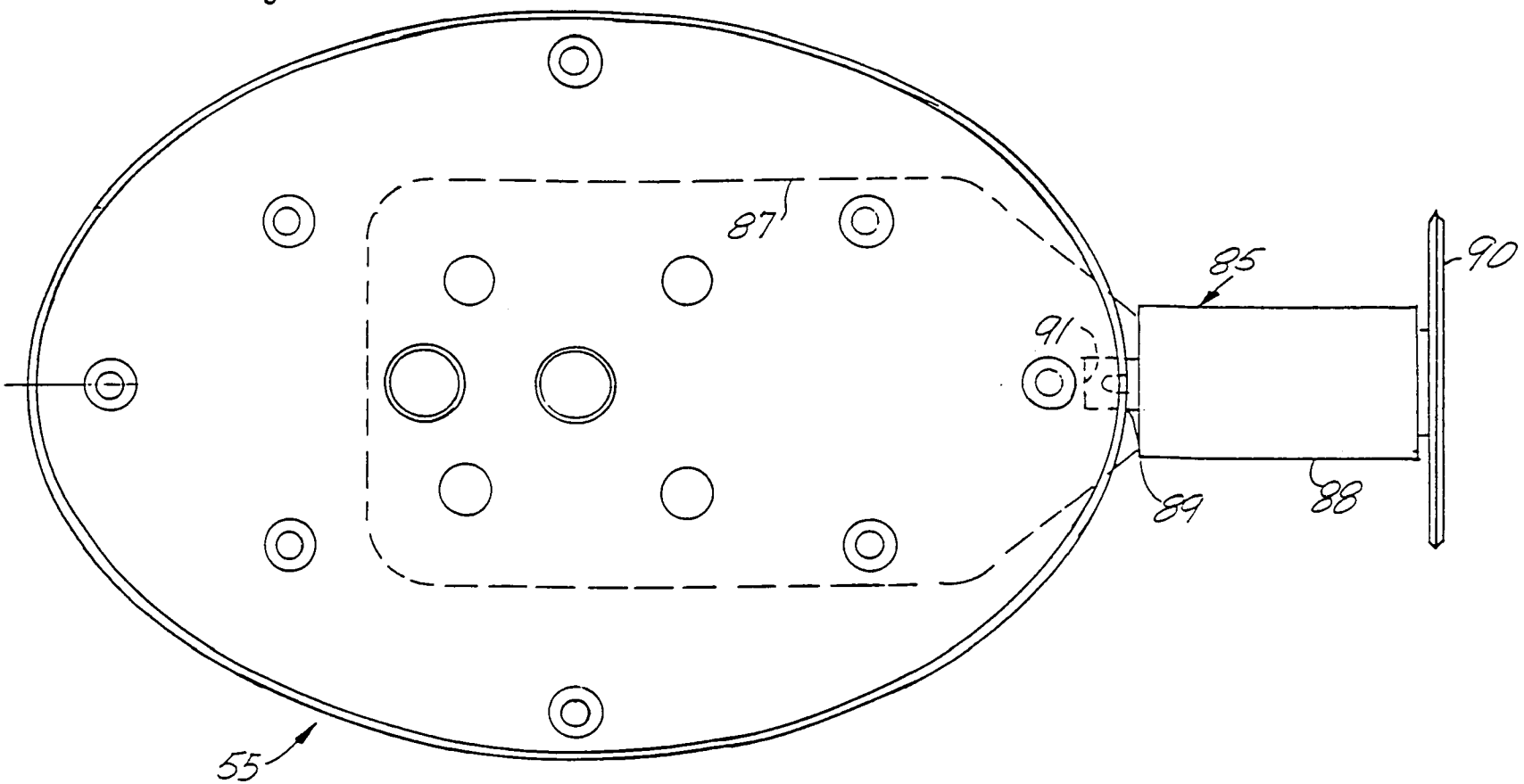
FIG. 9 is a top-plan view of the assembly shown in FIG. 8.

FIGS. 8 and 9 show a modified version of binding-base assembly 55 which includes a further feature of a lock assembly 85 which enables the front assembly to be temporarily locked in a fixed position when, for example, exiting from a ski lift, or during initial training.

Lock assembly 85 has a thin metal baseplate 87 (partially in phantom line in FIG. 9) which is secured to the front assembly 55 and positioned between lower plate 58 and the upper surface of board 67. The base plate extends rearwardly from assembly 55, and is folded upwardly and inwardly to form a socket or channel 88 which receives a sliding plunger 89 having an enlarged head 90.

When head 90 is pressed forwardly, the forward end of plunger 89 is pressed into and engages a mating recess 91 in lower plate 74 to prevent rotation of the assembly. Detents are preferably provided to latch the plunger in extended and retracted positions, and movement can be further restricted (for example, by a set screw extending laterally from the plunger within a closed slot in channel 88) to prevent complete withdrawal of the plunger.

Another additional feature is a clutch assembly 92 (FIGS. 6 and 10) which enables braking of free rotation by applying a side load to the board. Such temporary braking may be desired when traversing icy terrain. Clutch assembly 92 has an upper movable portion defined by a plurality of short circularly arranged and radially extending ribs 93 which are molded into the undersurface of lower plate 74. A pair of fixed clutch portions 94 are positioned on opposite sides of the board. Portions 94 are typically made of tough high-friction rubber, and are spaced apart only slightly from ribs during normal riding of the board. If the rider edge loads the board, flexing of the board brings the ribs into frictional engagement with the fixed clutch portions to brake the rotational movement. Ribs can also be formed on portions 94 if stronger braking action is desired.

Although the present invention is described in relation to several working embodiments for illustrative purposes, variations will be apparent to those skilled in the art. For example, the rotatable feature could be incorporated in the rider's boot without departing from the scope of the invention. Therefore, the present invention is not intended to be limited to the working embodiment described above. The scope of the invention is further defined in the following claims.

What is claimed is:

1. A sport board boot binding for receiving a single booted foot, said sport board boot binding comprising:

a centrally positioned bearing clamp, said centrally positioned bearing clamp comprising:

a lower plate comprising a lower plate radially outer portion, and a lower plate radially extending flange;

an upper plate comprising an upper plate radially outer portion, an upper plate radially extending flange and a downwardly extending central portion, said downwardly extending central portion having a lower surface, said lower surface of the downwardly extending central portion comprising the only contact between the upper plate and the lower plate; and a ball bearing assembly comprising an inner race and an outer race, said outer race comprising an upper portion and a lower portion, wherein said inner race of the ball bearing assembly is clamped between the upper plate radially extending flange on the top of the inner race and the lower plate radially extending flange on the bottom of the inner race.

2. The sport board boot binding of claim 1, wherein the upper plate radially outer portion of the upper plate is spaced from the lower plate radially outer portion of the lower plate.

3. The sport board boot binding of claim 1, said sport board boot binding further comprising:

a binding-support assembly comprising:

a lower binding-support plate; and an upper binding-support plate, wherein the outer race of the ball bearing assembly is clamped between the lower binding-support plate and the upper binding-support plate.

4. The sport board boot binding of claim 3, wherein said lower binding-support plate of said binding-support assembly further comprises:

a radially inwardly extending circular flange, wherein the radially inwardly extending circular flange of the lower binding-support plate extends below, and is spaced from, the lower plate of the centrally positioned bearing clamp.

5. The sport board boot binding of claim 1, said sport board boot binding further comprising:

a binding-support assembly comprising:

a lower binding-support plate comprising an upper side, said upper side of the lower binding-support plate comprising a lower binding-support plate upwardly extending vertical circular rib, said lower binding-support plate upwardly extending vertical circular rib comprising a first recess, wherein said first recess is adapted for receiving the lower portion of the outer race of the ball bearing assembly; and an upper binding-support plate comprising a lower side, said lower side of the upper binding-support plate comprising an upper binding-support plate downwardly extending vertical circular rib, said upper binding-support plate downwardly extending vertical circular rib comprising a second recess, wherein said second recess is adapted for receiving the upper portion of the outer race of the ball bearing assembly, wherein the outer race of the ball bearing assembly is clamped between the lower binding-support plate upwardly extending vertical circular rib and the upper binding-support plate downwardly extending vertical circular rib.

6. A single board sport board, said single board sport board comprising:

a surface for receiving at least one boot binding, said surface comprising a fore position and an aft position; and a first freely rotatable boot binding for receiving a booted foot, said first freely rotatable boot binding independently mounted in one of the fore position or the aft position on the surface of the board, said first freely rotatable boot binding adapted for frictionally unrestrained 360 degree rotation about a first axis during boarding movement, wherein said first axis is perpendicular to the board surface, and wherein said first freely rotatable boot binding comprises:

a centrally positioned bearing clamp, said centrally positioned bearing clamp comprising:

a circular lower plate comprising a lower plate radially outer portion, and a lower plate radially extending flange;

a circular upper plate comprising an upper plate radially outer portion, an upper plate radially extending flange and a downwardly extending central circular portion, wherein said downwardly extending central circular portion comprises a lower surface; and a bearing assembly comprising an inner race and an outer race, said outer race comprising an upper portion and a lower portion, wherein said inner race of the bearing assembly is clamped between the upper plate radially extending flange on the top of the inner race and the lower plate radially extending flange on the bottom of the inner race.

7. The single board sport board of claim 6, wherein said lower surface of the downwardly extending central circular portion comprises the only contact between the circular upper plate and the circular lower plate; and wherein the upper plate radially outer portion of the circular upper plate is spaced from the lower plate radially outer portion of the circular lower plate.

8. The single board sport board of claim 6, wherein said first freely rotatable boot binding further comprises:

a binding-support assembly comprising:

a lower binding-support plate; and an upper binding-support plate, wherein the outer race of the bearing assembly is clamped between the lower binding-support plate and the upper binding-support plate.

9. The single board sport board of claim 8, wherein said lower binding-support plate of said binding-support assembly further comprises:

a radially inwardly extending circular flange, wherein the radially inwardly extending circular flange of the lower binding-support plate extends below, and is spaced from, the circular lower plate of the centrally positioned bearing clamp.

10. The single board sport board of claim 6, said mounted first freely rotatable boot binding further comprising:

a binding-support assembly comprising:

a lower binding-support plate comprising an upper side, said upper side of the lower binding-support plate comprising a lower binding-support plate upwardly extending vertical circular rib, said lower binding-support plate upwardly extending vertical circular rib comprising a first recess, wherein said first recess is adapted for receiving the lower portion of the outer race of the bearing assembly; and an upper binding-support plate comprising a lower side, said lower side of the upper binding-support plate comprising an upper binding-support plate downwardly extending vertical circular rib, said upper binding-support plate downwardly extending vertical circular rib comprising a second recess, wherein said second recess is adapted for receiving the upper portion of the outer race of the bearing assembly, wherein the outer race of the bearing assembly is clamped between the lower binding-support plate upwardly extending vertical circular rib and the upper binding-support plate downwardly extending vertical circular rib.

11. A sport board boot binding for receiving a single booted foot, said sport board boot binding comprising:

a bearing clamp, said bearing clamp comprising:

a lower plate, an upper plate, and a ball bearing assembly comprising an inner race and an outer race, wherein said inner race of the ball bearing assembly is clamped between the lower plate and the upper plate; and a binding-support assembly comprising:

a lower binding-support plate, and an upper binding-support plate, wherein the outer race of the ball bearing assembly is clamped between the lower binding-support plate and the upper binding-support plate.

12. The sport board boot binding of claim 11, wherein said sport board boot binding is adapted for independent mounting in one of: a fore position on a surface of a sport board or an aft position on a surface of a sport board; and wherein said sport board boot binding is further adapted for unrestrained 360 degree rotation about a first axis during boarding movement, wherein said first axis is perpendicular to the board surface.

13. The sport board boot binding of claim 11, wherein said lower binding-support plate of said binding-support assembly further comprises:

a radially inwardly extending circular flange, wherein the radially inwardly extending circular flange of the lower binding-support plate extends below, and is spaced from, the circular lower plate of the bearing clamp.

14. The sport board boot binding of claim 13, wherein said sport board boot binding is adapted for independent mounting in one of: a fore position on a surface of a sport board or an aft position on a surface of a sport board; and wherein said sport board boot binding is further adapted for unrestrained 360 degree rotation about a first axis during boarding movement, wherein said first axis is perpendicular to the board surface.

15. The sport board boot binding of claim 11, wherein said lower binding-support plate comprises an outer perimeter, and wherein said outer perimeter of said lower binding-support plate is substantially elliptically shaped.

16. The sport board boot binding of claim 15, wherein said lower binding-support plate of said binding-support assembly further comprises:

a radially inwardly extending circular flange, wherein the radially inwardly extending circular flange of the lower binding-support plate extends below, and is spaced from, the circular lower plate of the bearing clamp.

17. The sport board boot binding of claim 11, wherein said upper binding-support plate comprises an outer perimeter, and wherein said outer perimeter of said upper binding-support plate is substantially elliptically shaped.

18. The sport board boot binding of claim 11, wherein said upper plate is circular, wherein said lower plate is circular, wherein said lower binding-support plate is substantially elliptically shaped, and wherein said upper binding-support plate is substantially elliptically shaped.

19. The sport board boot binding of claim 18, wherein said lower binding-support plate of said binding-support assembly further comprises:

a radially inwardly extending circular flange, wherein the radially inwardly extending circular flange of the lower binding-support plate extends below, and is spaced from, the circular lower plate of the bearing clamp.

20. The sport board boot binding of claim 19, wherein said sport board boot binding is adapted for independent mounting in one of: a fore position on a surface of a sport board or an aft position on a surface of a sport board; and wherein said sport board boot binding is further adapted for unrestrained 360 degree rotation about a first axis during boarding movement, wherein said first axis is perpendicular to the board surface.

* * * * *